US005544884A

United States Patent [19]

Hardman

[11] Patent Number: 5,544,884

[45] Date of Patent: Aug. 13, 1996

[54] GOLF CLUB WITH SKEWED SOLE

[75] Inventor: Thomas F. Hardman, Palm Beach Gardens, Fla.

[73] Assignee: Wilson Sporting Goods Co., Chicago, Ill.

[21] Appl. No.: 411,437

[22] Filed: Mar. 27, 1995

[51] Int. Cl.[6] ..... A63B 53/04

[52] U.S. Cl. ..... 473/327; 473/328

[58] Field of Search ..... 273/167 R, 167 A, 273/167 D, 164.1, 193 R, 194 R, 186.2, 187.4, 174; D21/214, 215, 216, 217, 218, 219, 220

[56] References Cited

U.S. PATENT DOCUMENTS

| | | | |
|---|---|---|---|
| D. 94,550 | 2/1935 | Jansky . | |
| D. 307,783 | 5/1990 | Iinuma | D21/214 |
| D. 310,254 | 8/1990 | Take | D21/214 |
| D. 318,087 | 7/1991 | Helmstetter . | |
| D. 343,434 | 1/1994 | Helmstetter . | |
| D. 343,664 | 1/1994 | Feche . | |
| D. 344,117 | 2/1994 | Helmstetter . | |
| D. 345,403 | 3/1994 | Sanchez . | |
| D. 362,039 | 9/1995 | Lin | D21/214 |
| 1,089,881 | 3/1914 | Taylor . | |
| 1,541,126 | 6/1925 | Dunn . | |
| 1,619,566 | 3/1927 | Crankshaw . | |
| 1,669,482 | 5/1928 | Miller . | |
| 1,774,590 | 9/1930 | Buhrke . | |
| 1,868,286 | 7/1932 | Grieve . | |
| 1,913,821 | 6/1933 | Stumpf . | |
| 2,014,829 | 9/1935 | Young . | |
| 2,550,846 | 5/1951 | Milligan . | |
| 3,166,320 | 1/1965 | Onions . | |
| 3,761,095 | 9/1973 | Thompson . | |
| 4,319,752 | 3/1982 | Thompson . | |
| 4,322,083 | 3/1982 | Imni . | |
| 4,332,388 | 6/1982 | Crow . | |
| 5,042,806 | 8/1991 | Helmstetter . | |
| 5,240,252 | 8/1993 | Schmidt . | |

FOREIGN PATENT DOCUMENTS

| | | |
|---|---|---|
| 36484 | 1/1932 | United Kingdom . |
| 452389 | 8/1936 | United Kingdom . |

*Primary Examiner*—Sebastiano Passaniti

[57] ABSTRACT

A golf clubhead includes a projection which extends downwardly from the sole of the clubhead. The projection extends rearwardly from the face of the clubhead and away from the heel of the clubhead. The projection extends generally in the direction in which the clubhead is moving when it impacts a golf ball.

13 Claims, 6 Drawing Sheets

GOLF CLUB WITH SKEWED SOLE

BACKGROUND AND SUMMARY OF THE INVENTION

This invention relates to golf clubs, and, more particularly, to a golf club which includes a projection on the sole which is skewed relative to the face of the clubhead.

Golf clubs are commonly provided with a projection or rail which extends downwardly from the sole of the clubhead. The projection is intended to engage the ground as the clubhead is swung toward a golf ball. Some golf club designers apparently believe that the projection advantageously affects the ability of the clubhead to move through turf or dirt and/or the ability of the clubhead to strike the ball.

Such projections generally extend perpendicularly to the face of the clubhead. However, if one examines the sole of a used clubhead, marks on the sole which are caused by golf tees or other objects as the clubhead is swung usually do not extend perpendicularly to the face. Such marks usually extend away from the heel of the clubhead and toward the toe either in a substantially straight line or in a curved line. When such marks appear on the sole, the clubhead is not moving in a direction which extends perpendicularly to the face during impact with the golf ball. Any projection or protruding part on the sole which is perpendicular to the face is not aligned with the direction of movement of the clubhead.

In accordance with the invention, one or more projections or protrusions on the sole of a clubhead extend rearwardly from the face and away from the heel. The projection can be straight or curved, and at least a portion of the projection extends at an angle of about 5° to 15° from a plane which is perpendicular to the center of the face. The projection is aligned with the direction of movement of the clubhead at impact and allows the clubhead to pass through impact with minimum resistance.

DESCRIPTION OF THE DRAWING

The invention will be explained in conjunction with an illustrative embodiment shown in the accompanying drawing, in which.

DESCRIPTION OF THE EMBODIMENTS

Figure 1:
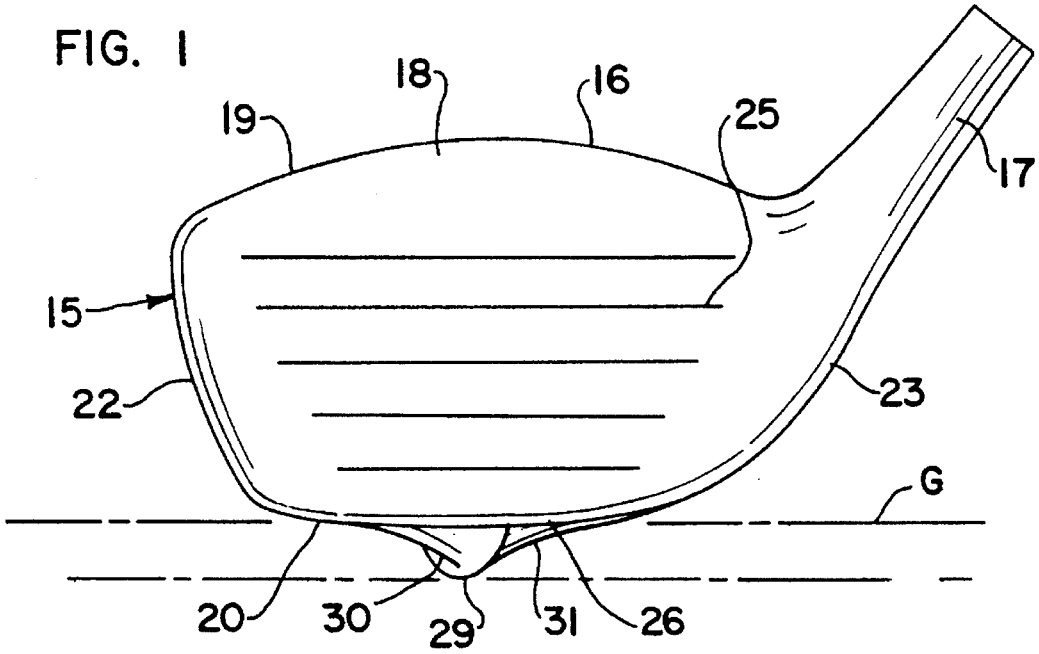
FIG. 1 is a front elevational view of a clubhead formed in accordance with the invention.

FIG. 1 illustrates a golf clubhead 15 which includes a body 16 and a hosel 17. The particular clubhead illustrated is a wood type of clubhead, which can be made from wood, metal, composite material, or other conventional materials. However, the invention can also be used with iron clubheads.

The clubhead 15 includes a front striking face 18, a generally dome-shaped top wall 19, a bottom surface or sole 20, a rear wall 21, a toe wall 22, and a heel wall 23 which merges with the hosel 17. A shaft (not shown) is inserted into the hosel.

The face 18 is generally flat and is provided with a plurality of generally parallel grooves 25. The bottom of the face is defined by a leading edge 26. The grooves extend parallel to a ground plane G which is tangent to the center of the leading edge when the clubhead is grounded or soled at address in the position intended by the club designer.

The face of a wooden type of golf club is often provided with bulge and roll curvature so that the face is not planar. However, for purposes of orientation of various parts of the clubhead, club designers often consider a plane P which is tangent to the center of the face and which extends generally parallel to the face.

Figure 2:
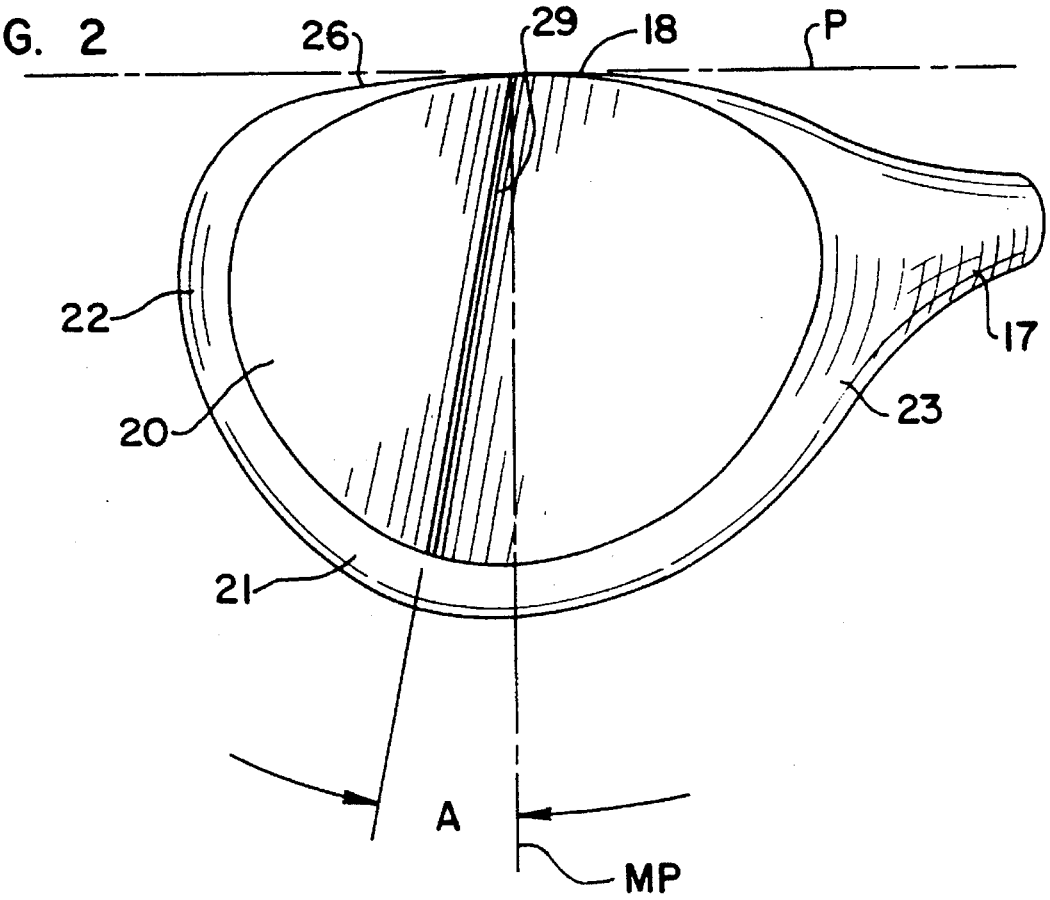
FIG. 2 is a bottom plan view of the clubhead of FIG. 1.

A projection 28 extends downwardly from the sole. The particular projection illustrated in FIGS. 1 and 2 has a generally V-shaped bottom or keel 29 and a pair of side surfaces 30 and 31. The bottom 29 and sides 30 and 31 are generally parallel and extend rearwardly from the face 18 in a direction which extends away from the heel 23 and toward the toe 22. The projection in the embodiment illustrated in FIGS. 1 and 2 is substantially straight and extends from the face to the rear wall 21. However, the projection can extend for only a portion of the distance between the face and the rear wall if desired.

The V-shaped bottom 29 and the side surfaces 30 and 31 extend at an acute angle with respect to the portion of the face which is between the center of the face and the toe 22. The projection 28 extends at an angle A to a midplane MP which extends perpendicularly to the center of the face and to the plane P. The midplane MP is vertical when the clubhead is soled on the ground plane G in the position which is intended by the designer. The angle A is within the range of about 5° to about 15°, and is preferably about 10°.

Figure 3:
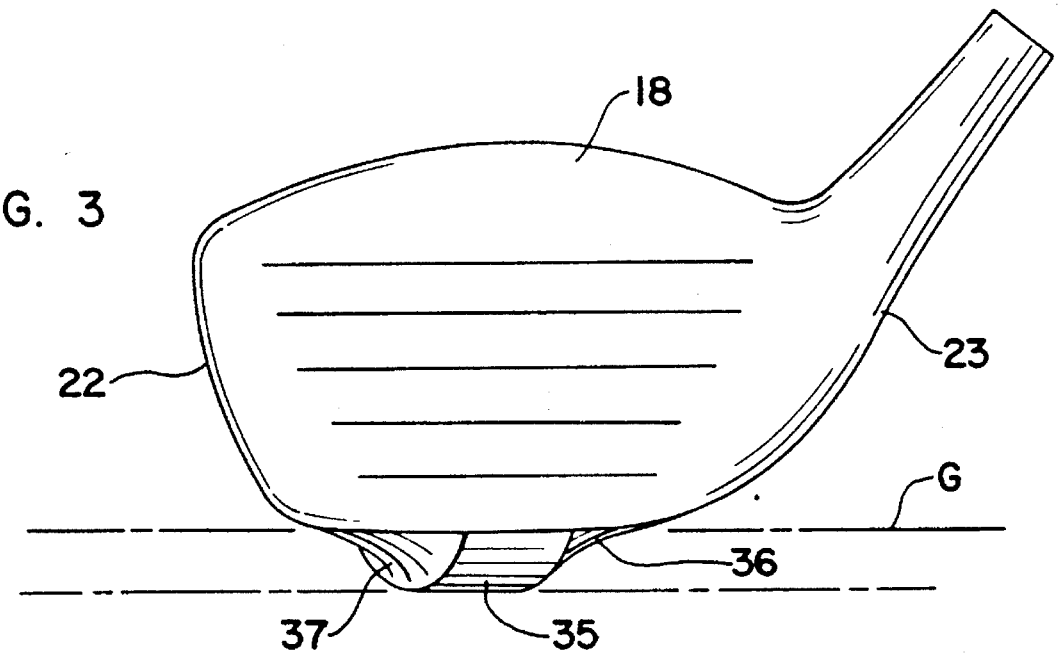
FIGS. 3 and 4 are views similar to FIGS. 1 and 2 showing another embodiment of the invention.
Figure 4:
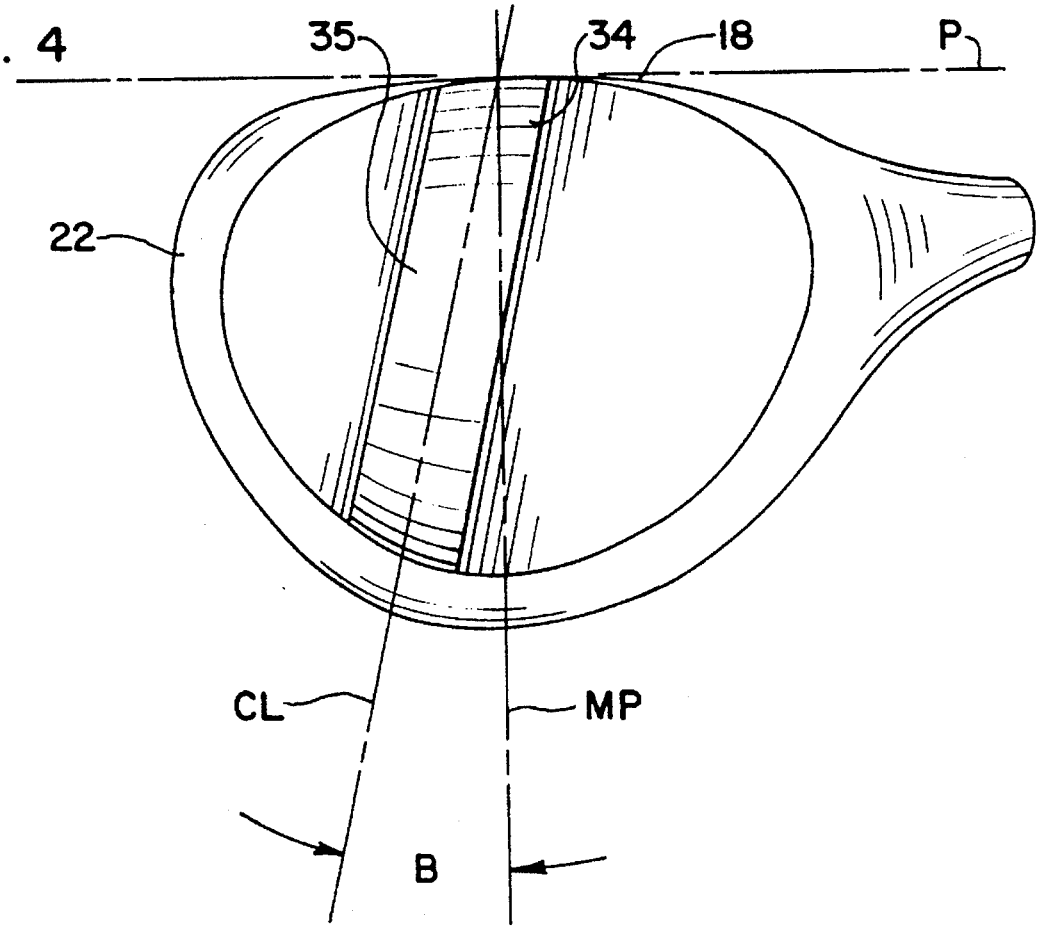

FIGS. 3 and 4 illustrate another embodiment of a projection 34. The projection 34 includes a generally flat bottom surface 35 and a pair of sloped side surfaces 36 and 37. A centerline CL of the projection extends at an angle B to the midplane MP. The angle B is about 5° to about 15°, and preferably about 10°. The width of the flat bottom surface can be about ¼ to about 1¼ inch.

Figure 5:
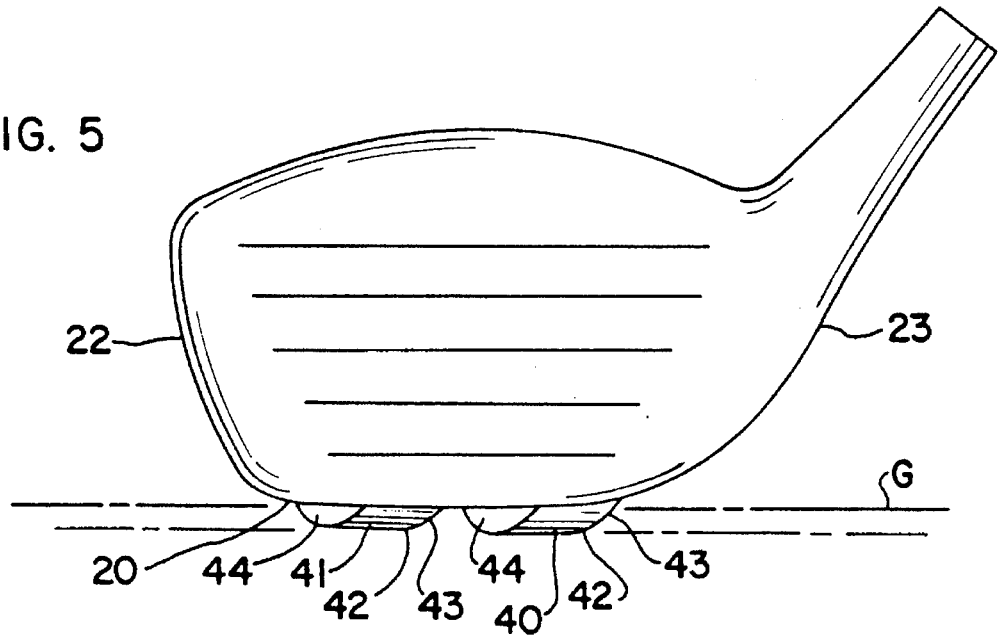
FIGS. 5 and 6 are views similar to FIGS. 1 and 2 showing a different embodiment of the invention.
Figure 6:
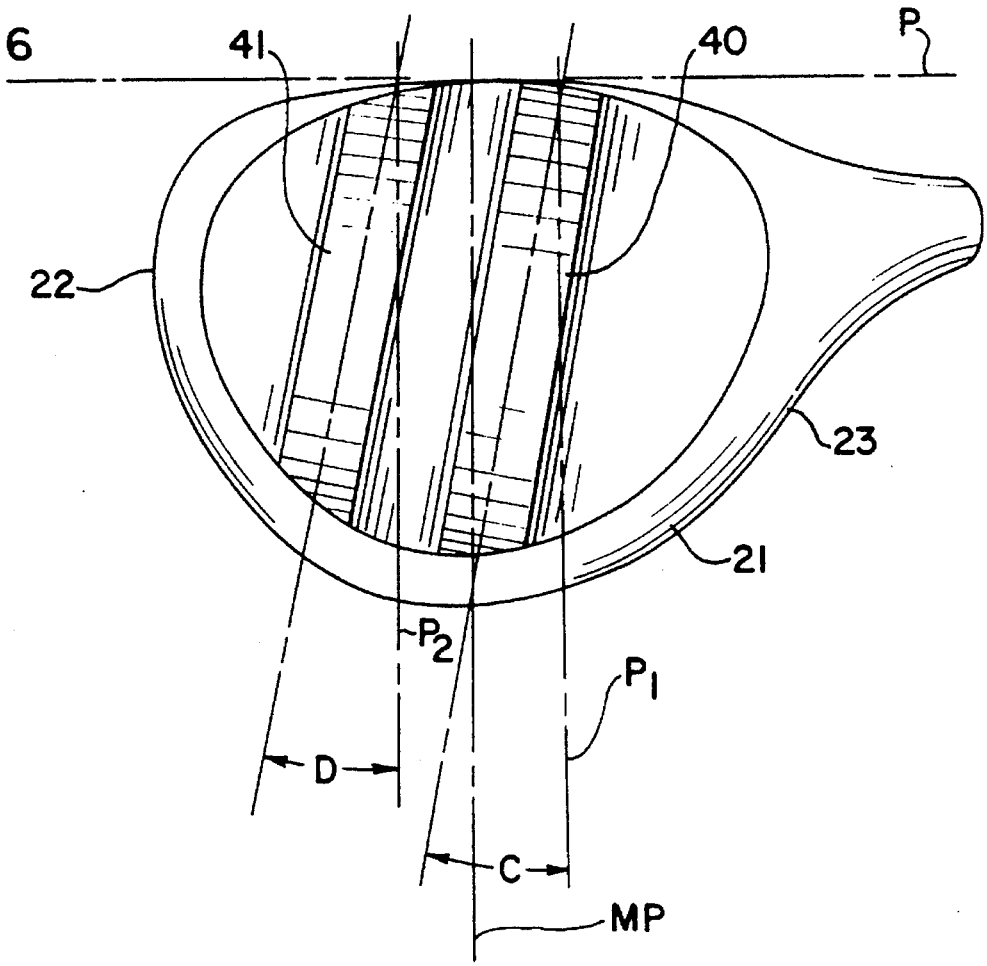

FIGS. 5 and 6 illustrate a pair of projections 40 and 41. Each projection includes a generally flat bottom surface 42 and a pair of sloped side surfaces 43 and 44. The width of each of the flat bottom surfaces can be about ¼ to about ¾ inch.

The projection 40 extends at an angle C to a plane $P_1$ which is parallel to the midplane MP, and the projection 41 extends at an angle D to a plan $P_2$ which extends parallel to the midplane MP. Each of the angles C and D is within the range of about 5° to about 15°, and is preferably about 10°. The projections are substantially equally spaced from the midplane P at the point where the projections merge with the face of the clubhead.

Figure 7:
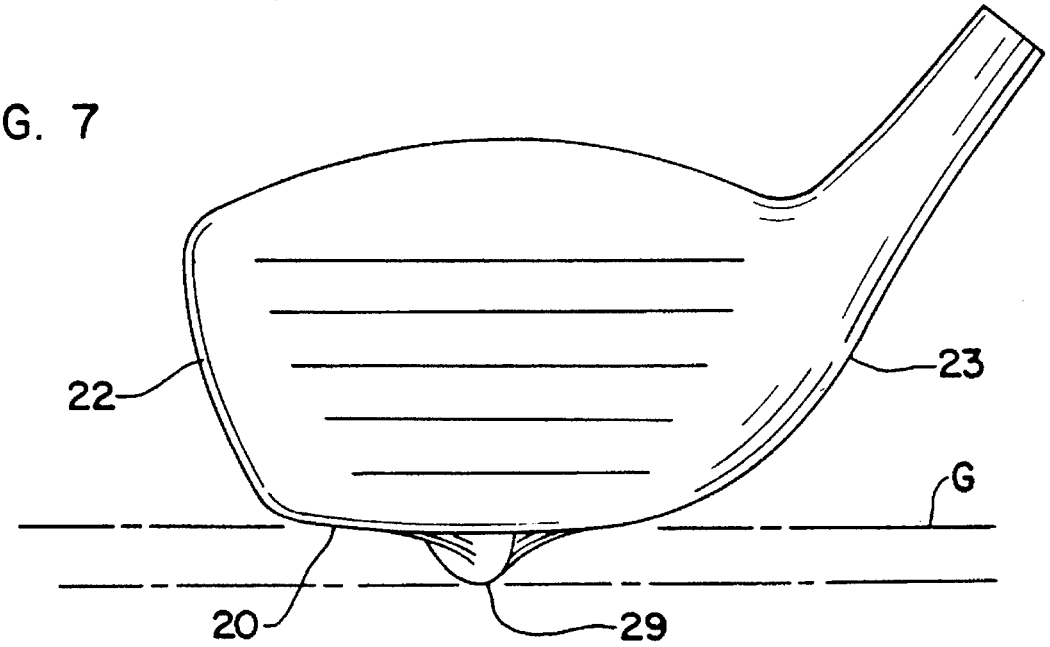
FIGS. 7 and 8 are views similar to FIGS. 1 and 2 showing still another embodiment of the invention.
Figure 8:
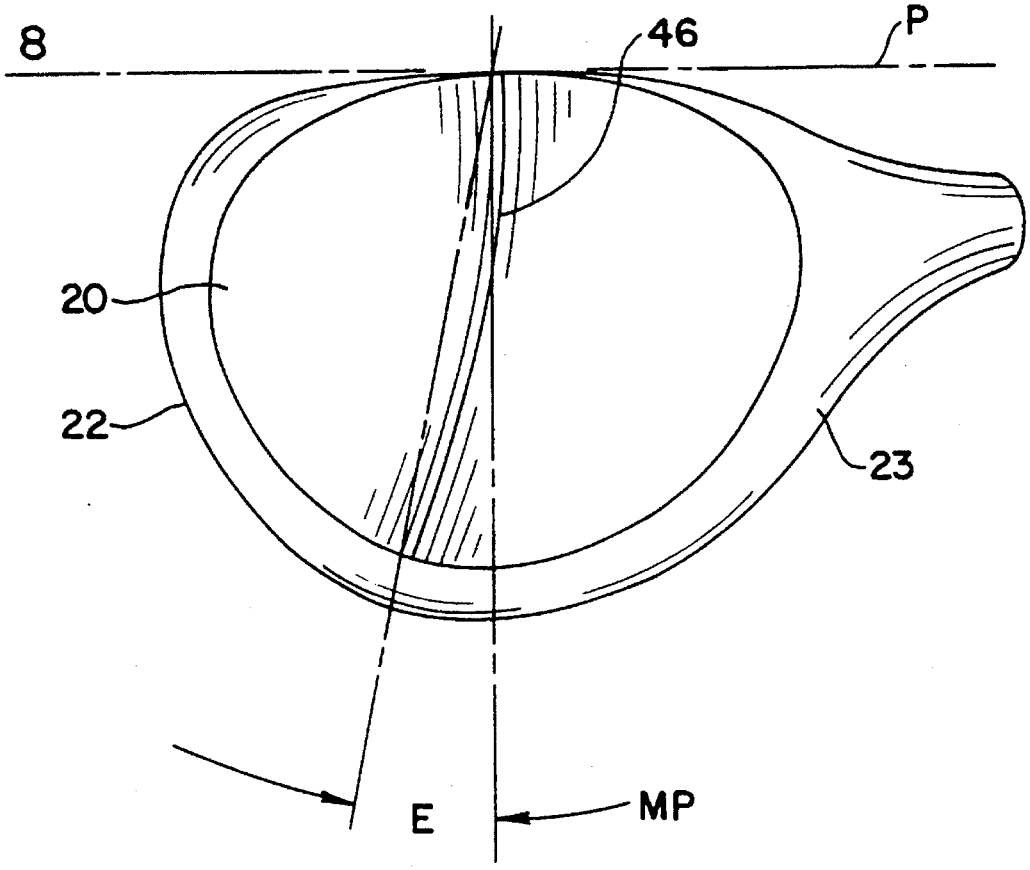

FIGS. 7 and 8 illustrate a projection 46 which is similar to the projection 29 of FIGS. 1 and 2 except that the projection 46 curves rearwardly and toward the toe. A chord 47 which intersects the middle of the projection at the face and at the back of the club extends at an angle E to the midplane MP. The angle E is about 5° to about 15°, and preferably about 10°.

Figure 9:
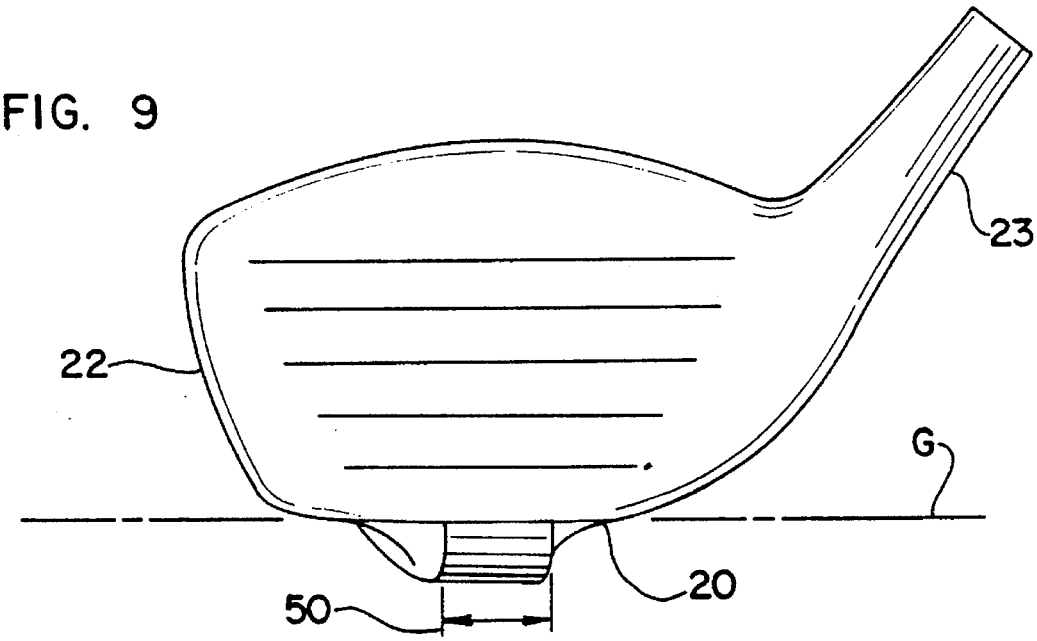
FIGS. 9 and 10 are views similar to FIGS. 1 and 2 showing yet another embodiment of the invention.
Figure 10:
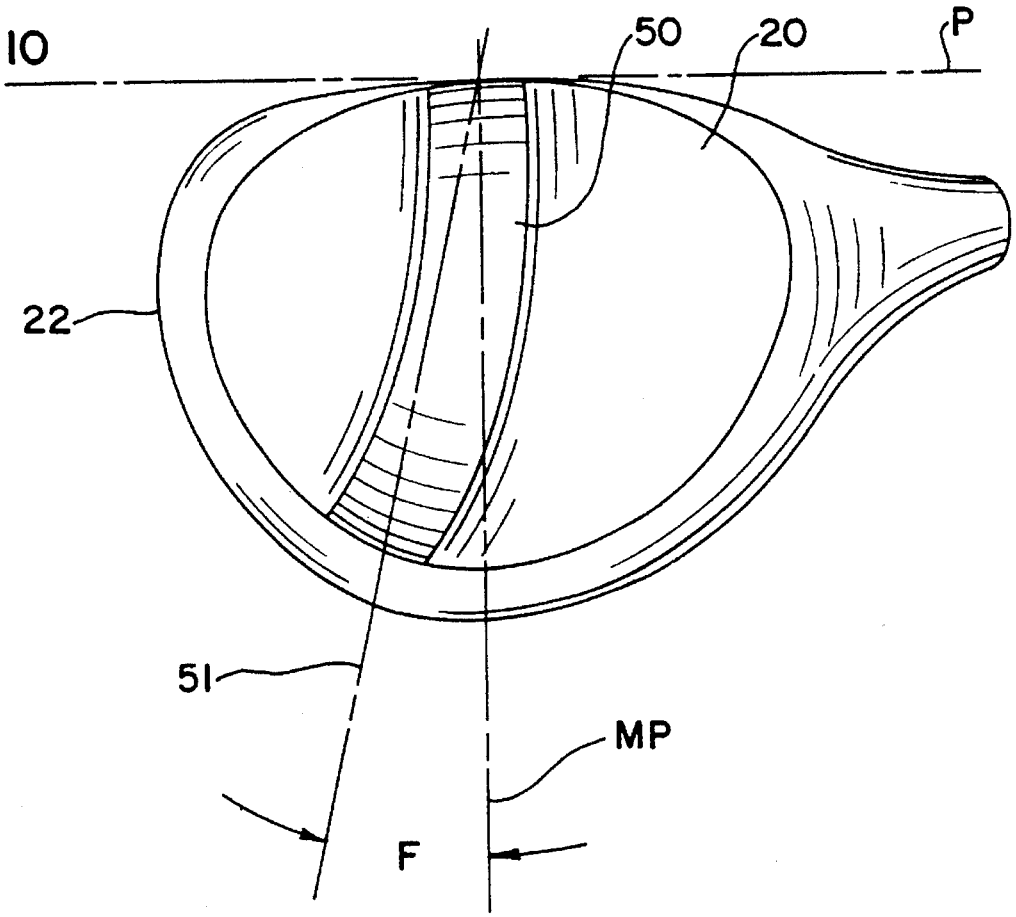

FIGS. 9 and 10 illustrate a projection 50 which is similar to the projection 35 illustrated in FIGS. 3 and 4 except that the projection 50 curves rearwardly and toward the toe. A chord 51 which extends between the middle of the projection 50 at the face and at the back of the clubhead extends at an angle F to the midplane MP. The angle F is about 5° to about 15°, and preferably about 10°.

Figure 11:
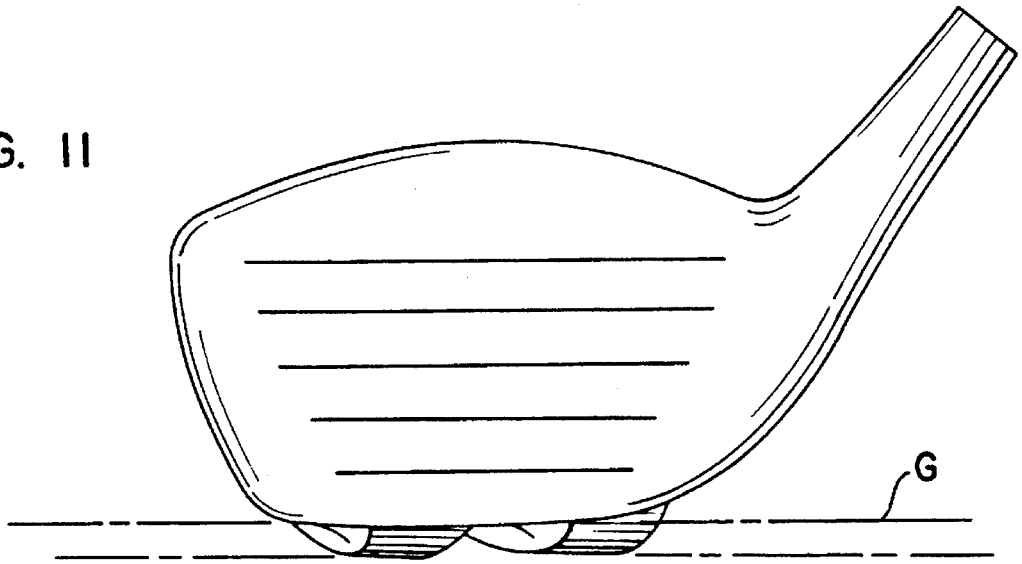
FIGS. 11 and 12 are views similar to FIGS. 1 and 2 showing another embodiment of the invention.
Figure 12:
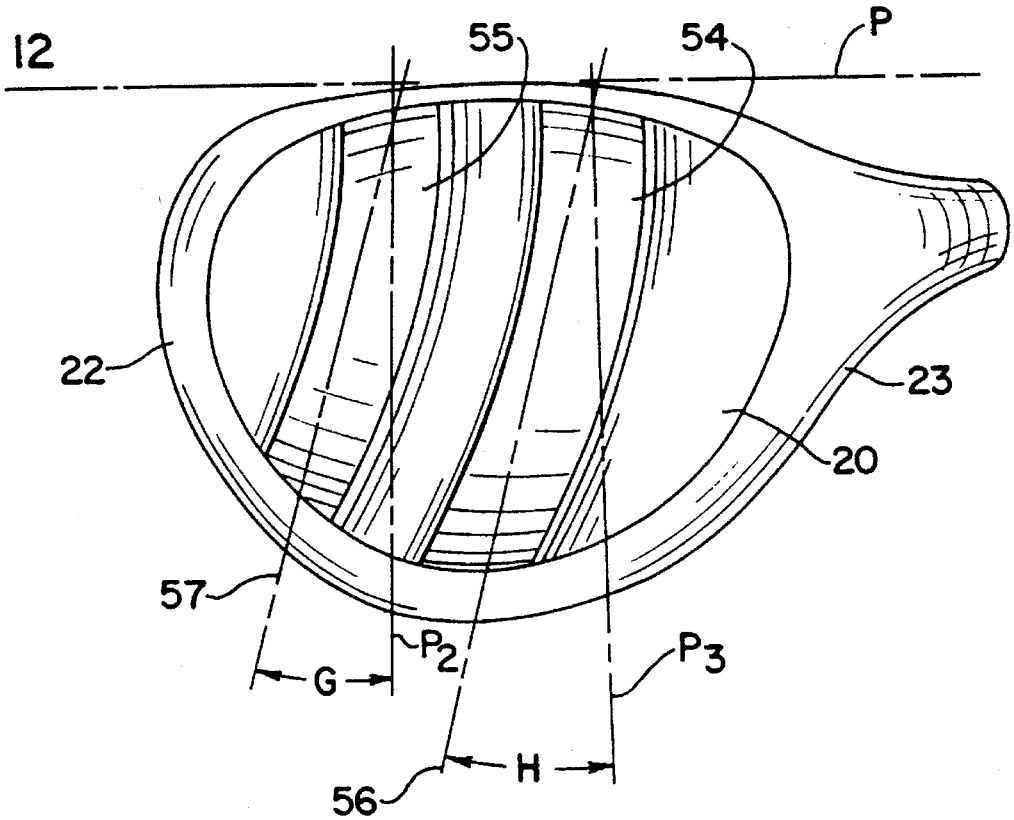

FIGS. 11 and 12 illustrate projections 54 and 55 which are similar to the projections 40 and 41 of FIGS. 5 and 6 except that the projections 54 and 55 curve rearwardly and toward the toe. Chords 56 and 57 which extend between the intersections of the projections 54 and 55 with the face and the back of the clubhead, respectively, extend at angles G and H to planes $P_3$ and $P_4$ which extend parallel to the midplane MP. The angles G and H are about 5° to about 15°, and preferably about 10°.

The reason for marks on the sole of the club extending toward the toe in either a straight line or in a curved line is not completely understood. However, I believe that these marks are oriented in that direction because the center of gravity of a wood type golf club is generally located more toward the heel of the clubhead rather than toward the toe. If the clubhead impacts a golf ball on the center of the clubhead while the clubhead is proceeding in substantially a straight line along the intended line of flight, the clubhead will start an immediate rotational movement in a clockwise direction, looking down on the clubhead from above the crown. The clockwise rotation causes the clubhead to proceed through the impact area with both a linear and a rotational movement. It is also possible that some marks are caused by having the clubhead contact the ball when the clubhead is moving along an outside-in swing path rather than an inside-out swing path.

While I do not fully understand why the marks on the sole are oriented in a direction which extends toward the toe, the orientation of the projections or protrusions on the sole in accordance with the invention allow the clubhead to proceed in the direction in which it is forced by impact with a golf ball with a minimum of resistance.

While in the foregoing specification a detailed description of specific embodiments of the invention were set forth for the purpose of illustration, it will be understood that many of the details herein given can be varied considerably by those skilled in the art without departing from the spirit and scope of the invention.

I claim:

1. A golf clubhead comprising a body having a striking face, a toe, a heel, a top portion, a back portion, and a sole, the sole having only a single downwardly extending projection between the toe and the heel the remainder of said sole being free of any projections, the single projection extending rearwardly from the face and away from the heel, whereby the clubhead is forced to proceed with a minimum of resistance in a heel-to-toe direction upon impact of the striking face with a golf ball.

2. The clubhead of claim 1 in which the projection forms an acute angle with the portion of the face which extends between the projection and the toe.

3. The clubhead of claim 1 in which the projection is substantially straight.

4. The clubhead of claim 1 in which the projection curves rearwardly and toward the toe.

5. The clubhead of claim 1 in which the projection includes a generally V-shaped bottom surface.

6. The clubhead of claim 1 in which the projection includes a substantially flat bottom surface.

7. The clubhead of claim 1 in which the projection includes a pair of sides which extend rearwardly from the face and away from the heel.

8. The clubhead of claim 1 in which a portion of the projection extends at an angle of about 5° to 15° to a plane which extends perpendicularly to the center of the face.

9. The clubhead of claim 1 including a second downwardly extending projection which extends generally parallel to the first-mentioned projection.

10. A golf clubhead comprising a body having a striking face, a toe, a heel, a top portion, a back portion, and a sole, the sole having a pair of parallel downwardly extending projections between the toe and the heel, the projections extending rearwardly from the face and away from the heel.

11. The clubhead of claim 10 in which the projections curve rearwardly and toward the toe.

12. The clubhead of claim 10 in which each of the projections includes a substantially flat bottom surface.

13. The clubhead of claim 10 in which a portion of each projections extends at an angle of about 5° to 15° to a plane which extends perpendicularly to the center of the face.

* * * * *